US005603682A

United States Patent [19]

Grider

[11] Patent Number: 5,603,682

[45] Date of Patent: Feb. 18, 1997

[54] BACK-PAD CUSHION ADJUSTING DEVICE FOR USE ON A MULTI-STATION GYM

[76] Inventor: Sherman P. Grider, 14829 E. Salt Lake Ave., City of Industry, Calif. 91746

[21] Appl. No.: 383,869

[22] Filed: Feb. 6, 1995

[51] Int. Cl.[6] ..... A47C 1/026; A63B 103/00

[52] U.S. Cl. ..... 482/142; 297/357; 248/292.14; 482/134; 482/908

[58] Field of Search ..... 297/383, 357, 297/353, 376, 344.13, 354.11, 354.12, 358; 248/291, 298, 299, 300, 297.31, 299.1, 287.1, 292.14; 482/133–138, 142, 148, 908

[56] References Cited

U.S. PATENT DOCUMENTS

| | | | |
|---|---|---|---|
| 1,922,418 | 8/1933 | Conant | 297/357 |
| 2,355,762 | 8/1944 | Van Derveer | 297/357 |
| 2,411,063 | 11/1946 | Scott | 297/357 |
| 2,734,708 | 2/1956 | Cohn | 248/299 |
| 3,110,504 | 11/1963 | Myers | 297/357 |
| 3,182,946 | 5/1965 | Dudko | 248/299.1 |
| 4,368,866 | 1/1983 | Urban | 248/286.1 |
| 4,394,047 | 7/1983 | Brunelle | 297/362.12 |
| 4,475,770 | 10/1984 | Persons, II | 297/353 |
| 4,629,180 | 12/1986 | Kaya | 482/140 |
| 4,637,608 | 1/1987 | Owens et al. | 482/142 |
| 4,781,350 | 11/1988 | Boucher | 248/287.1 |
| 4,844,456 | 7/1989 | Habing et al. | 482/100 |
| 4,930,768 | 6/1990 | Lapcevic | 482/100 |
| 4,964,629 | 10/1990 | Wright | 482/100 |
| 5,169,221 | 12/1992 | Wheeler | 248/299.1 |
| 5,299,998 | 4/1994 | Hutchins | 482/135 |
| 5,338,278 | 8/1994 | Endelman | 482/142 |
| 5,487,590 | 1/1996 | Haynes | 482/134 |

FOREIGN PATENT DOCUMENTS

| | | | |
|---|---|---|---|
| 1013331 | 7/1952 | France | 297/357 |

*Primary Examiner*—Jerome Donnelly
*Assistant Examiner*—Victor K. Hwang
*Attorney, Agent, or Firm*—Albert O. Cota

[57] ABSTRACT

A back pad cushion adjusting device for use on a multi-station gym. The device includes a bracket (20) defining a mounting face (22) and a pair of parallel outwardly extending arms (24) each having upper and lower slots. Each of the slots receive a threaded fastener such as a shoulder bolt (34) that is screwed into the gym frame upright (40). The fastener is smaller than the slot permitting the bracket and an attached back pad cushion (26) to be lifted up and repositioned into a different part of the slot or combination thereof. Two embodiments of the slot provide the back-pad cushion with different horizontal and angular adjustments.

2 Claims, 3 Drawing Sheets

BACK-PAD CUSHION ADJUSTING DEVICE FOR USE ON A MULTI-STATION GYM

TECHNICAL FIELD

The present invention pertains to adjusting brackets and more particularly to an improvement in an adjusting bracket for a back cushion used as part of a multi-station gym.

BACKGROUND ART

The field of exercising weight training and physical therapy is replete with exercising apparatuses that are designed to exercise practically every part of the human body. These exercising apparatuses include individual hand-grip exercises, bar-bells and dumbbells, treadmills and other aerobic and non-aerobic apparatuses. One of the most popular exercise apparatus is referred to as a multi-station gym that incorporates into a single structure all the elements necessary to perform a: bench press, shoulder press, lat pulldown, tricep pushdown, abdominal crunch, pectoral contractor, rear deltoid, leg curl, leg extension, standing arm curl, leg press, upright row, seated row, lower backextension and a back hyperextension.

Most multi-station gyms incorporate a seat and a cushioned back pad that is angularly adjusted by a back-pad adjusting device. The adjustment is necessary to compensate for the stature of the exercising individual and/or to perform some of the above-listed exercises. In many of the current multi-station gyms, the back-pad adjusting device is complex and is not ergomonical designed to allow the back pad to be easily and quickly adjusted. The inventive back-pad adjusting device is simply and ergomonical designed to allow the back pad to be quickly and easily positioned.

A search of prior art patents and sales literature did not disclose any back-pad adjusting designs that read directly on the claims of the instant invention, however the following U.S. patents were considered related:

| PAT. NO. | INVENTOR | ISSUED |
|---|---|---|
| 4,015,878 | Perkins | 5 April 1977 |
| 2,985,225 | Hendrickson et al | 23 May 1961 |
| 1,922,418 | Conant | 15 August 1933 |

The Perkins U.S. Pat. No. 4,015,878 discloses a chair construction that includes a lower back and an upper back. The upper back is selectively positionable vertically relative to the lower back by a releasable retaining mechanism. This mechanism includes a ratchet and pawl means that consists of a pair of parallel spaced, vertically extending toothed racks. The racks are fixed laterally to the rear side of the upper back rest and engage a movable parallel bar that allows the upper back to be vertically positioned.

The Hendrickson et al U.S. Pat. No. 2,985,225 disclosed a seat having a base and a back rest section. The back rest section is pivotally adjusted relative to the seat by a latching mechanism. The mechanism consists of a notched plate that is attached to the side of the back rest and a spring-loaded latching rod. To adjust the back rest, the latching rod is pulled outwardly, the back rest is selectively positioned and the latching rod is released into a selected notch on the notched plate.

The Conant U.S. Pat. No. 1,922,418 discloses a posture regulating chair that includes a mechanism for adjusting the back portion of the chair. The mechanism includes a pivoting member which has an arcuate slot with a plurality of cavities on its upper edge. The cavities mesh with a pin that is inserted into one of the cavities to regulate the position of the back portion of the chair.

For background purposes and as indicative of the art to which the invention relates reference may be made to the following patents issued to:

| PAT. NO. | INVENTOR | ISSUED |
|---|---|---|
| 4,394,047 | Brunelle | 19 July 1983 |
| 3,235,308 | Conner | 15 Feb. 1964 |
| 3,015,520 | Johnson | 2 Jan. 1962 |
| 2,355,762 | Van Derveer | 17 June 1938 |

DISCLOSURE OF THE INVENTION

Multi-station exercise gyms for both home and commercial use employ adjustable back pads or cushions to provide a rest or stop for the exercising participant. Since many presently available exercising machines are designed to perform multiple functions, the back pad cushion must be repositioned to suit the particular purpose. As an example, when the pectoral contractor muscles are exercised with the arms outstretched, the back is only slightly tilted from vertical, however the location from the seat will change according to the size and frame of the person exercising therefore, usually some horizontal adjustment must be made. Rear deltoid muscle workout requires pressing the front of the body into the back cushion which may require a change in either distance from the frame or the angle of the cushion relative to the body or both. Further when horizontal resistance is required, such as in a bench press, from a seated position, one's arms push against a weight resisting press bar and one's back against the back cushion therefore, the cushion should be in a relatively vertical position. Shoulder pressing from a seated position on the other hand is similar however, the cushion must be rotated forward on the top to angle the exerciser's body outwardly.

It is therefore a primary object of the invention to provide a simple adjusting device for a back pad cushion using a channel shaped bracket with slots in each side that slip over bolts screwed into the frame. Known prior art gyms use rectangular metallic tubing as the vertical frame structural member making this invention ideal for the application. As an example, Task Industries Inc. of City of Industry, Calif. in their so called TGsorics and Muscle three style utilize this type of frame construction.

The invention includes two embodiments, one using a pair of inverted E-shaped slots for the pectoral contractor and rear deltoid muscle exercise and the other a vertical slot and an upper arc shaped slot for the pressing type workouts. The E-shaped slots permit five distinct adjustments in distance and angularity to the frame and the arc shaped slot provides two cushion angles.

An important object of the invention is the ability of the device to be easily manipulated by one person. To reposition the cushion, simply lift upward disconnecting the slots from where they were resting on the bolts and select the slot best suited for the application. This may be accomplished without even leaving the machine.

Another object of the invention is directed to the ease in which the device is understood. Since the slots are visible from both sides of the structural framework, it is easy to visualize which slot will be needed for the adjustment. No pop-pins or knobs are to be pulled out to release a hidden stop and it is unnecessary to require optional gas cylinders to assist in the adjustment since the weight of the bracket attached to the cushion is light and not prohibitive to lift up even by persons of small stature.

Still another object of the invention is its cost effectiveness as the bracket is easily manufactured by simple shearing, punching and forming procedures well known in the art. The use of shoulder bolts and threaded inserts or bosses in the frame are easily installed and require no special alignment or fitting making the invention considerably less expensive than brackets, inner connecting tubes, sliding knobs and gas cylinders in present use.

These and other objects and advantages of the present invention will become apparent from the subsequent detailed description of the preferred and other embodiments also the appended claims, further, taken in conjunction with the accompanying drawings.

BEST MODE FOR CARRYING OUT THE INVENTION

Figure 1:
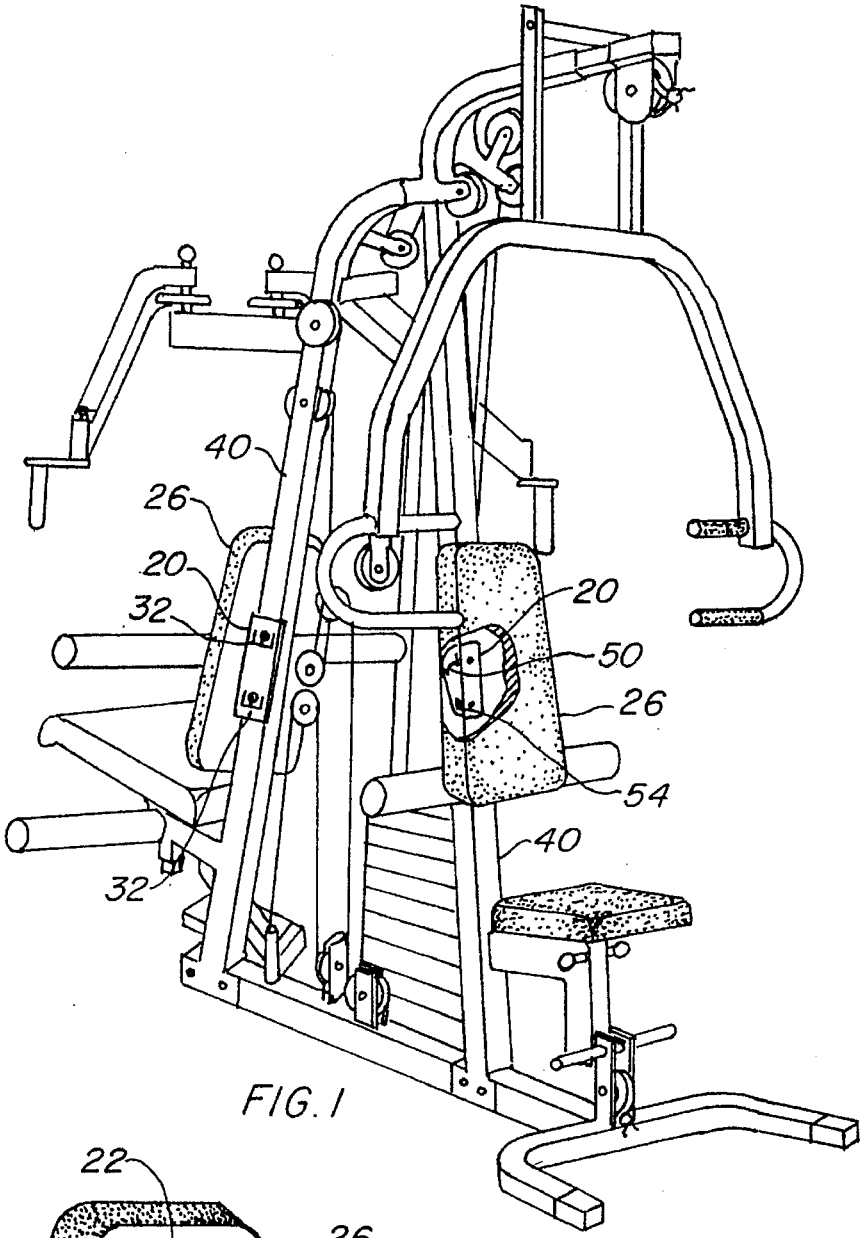
FIG. 1 is a partial isometric view of an exercise gym with the invention in both embodiments mounted in place on the gym structural frame upright members.
Figure 2:
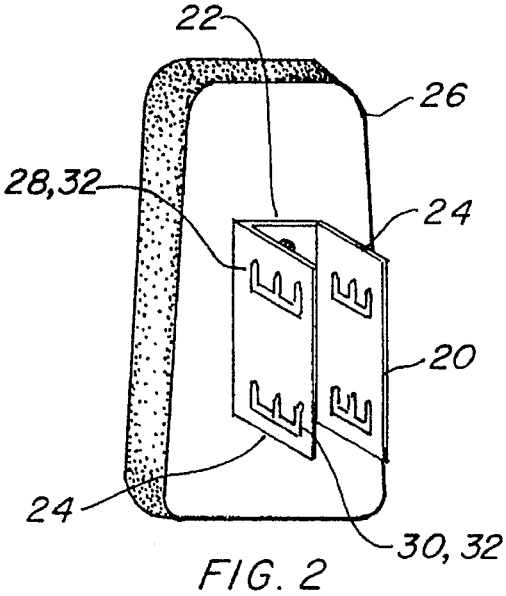
FIG. 2 is a partial isometric view of an E-shaped slotted embodiment removed from the gym for clarity.
Figure 3:
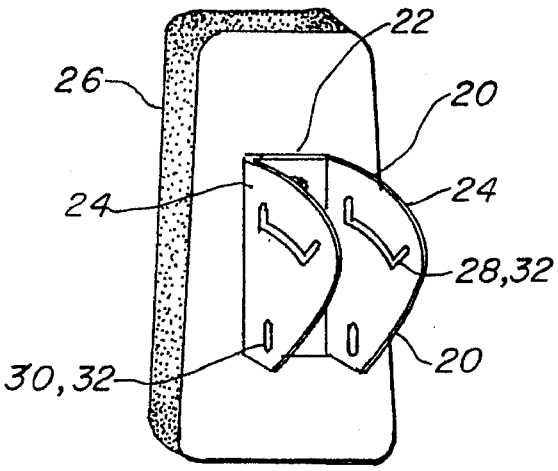
FIG. 3 is a partial isometric view of the arc shape slotted embodiment removed from the gym for clarity.

The best mode for carrying out the invention is presented in terms of a preferred embodiment in two separate configurations. Both embodiments contain the same basic structure, however the slots vary slightly in form to suit their specific task.

The preferred embodiment in the E-shaped slotted configuration as shown in FIGS. 1, 2 and 4–9 is comprised of a channel shaped bracket 20 having a back pad cushion mounting face 22 and a pair of parallel outwardly extending arms 24 that are integral with the face. The mounting face 22 is configured to mate with the rear surface of a back pad cushion 26, usually flat, however other shapes do not limit the scope of this invention.

The bracket 20 is preferably fabricated of sheet metal such as hot or cold rolled steel that is sheared and punched in the flat and formed in a press brake into the channel shape. Other materials such as aluminum may be substituted with equal ease.

Each of the arms 24 contain opposed upper slot means 28 that permit positioning in an adjustable manner. Similarly, the arms 24 also include lower slot means 30 for the same purpose. In this configuration of the preferred embodiment, both the upper and lower slot means are identical and are in the form of an elongated slot in inverted "E" shape or so called E-slot 32. Each portion of the slot 32 is wide enough on the inside to clear a cylindrical object for mounting and slide unobstructally throughout the entire shape of the "E" including the transition between the interconnecting back and legs. In this embodiment configuration, the slots 32 are positioned equal distance from the front of the arms 24 and in line vertically as illustrated in FIGS. 1, 4–9.

A threaded fastener in the form of a shoulder bolt 34, or a hex bolt 36 and a cylindrical spacer 38 attaches the bracket 20 to a frame upright 40 of the exercise gym as depicted in FIG. 1. This fastening arrangement permits the entire bracket 20 to be lifted upwardly and be shifted into different legs of the E-slot 32 relocating the bracket 20 in alternate positions. It should be noted that the diameter of the shoulder bolt 34 or spacer 38 is smaller than the slot 32 permitting the bracket to slide freely therewithin. As an alternative, the spacer 38 may be eliminated and the hex bolt 36 will function normally with some deformation of the threads or the bolt length may be selected having an unthreaded shank, the proper distance from the head.

Figure 5:
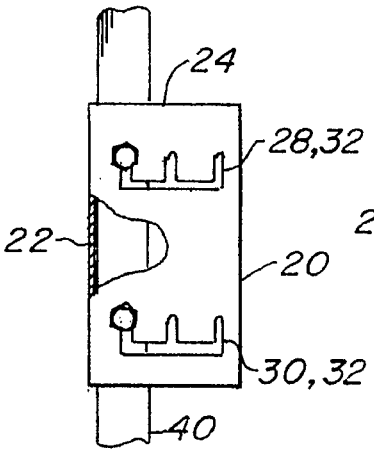
FIG. 5 is an elevational view of the E-shaped slotted embodiment in the vertical position nearest to the frame.
Figure 6:
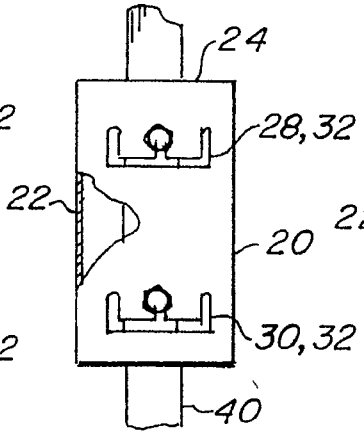
FIG. 6 is an elevational view of the E-shaped slotted embodiment in the vertical position in the middle.
Figure 7:
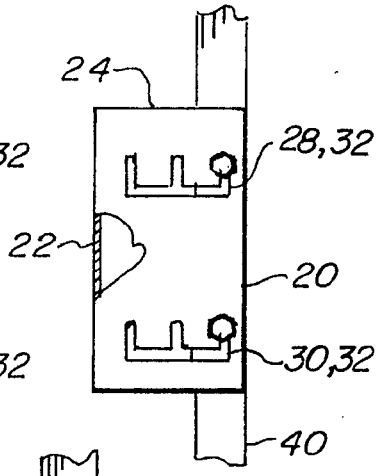
FIG. 7 is an elevational view of the E-shaped slotted embodiment in the vertical position furthest from the frame.

With the bracket 20 slideably connected to the gym frame upright 40, the spacing from the edge of the upright to the bracket face 22 may be changed in three spaced positions as shown in FIGS. 5–7. The closest position of the bracket 20 is shown in FIG. 5 and the furthest in FIG. 7. It may be easily understood that by lifting the bracket 20 upwardly and shifting laterally when the threaded fasteners are in the base of the E, a new position is selected when the bracket is lowered.

Figure 8:
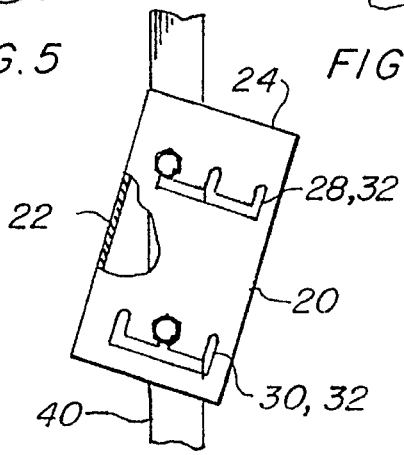
FIG. 8 is an elevational view of the E-shaped slotted embodiment in the angular position nearest to the frame.
Figure 9:
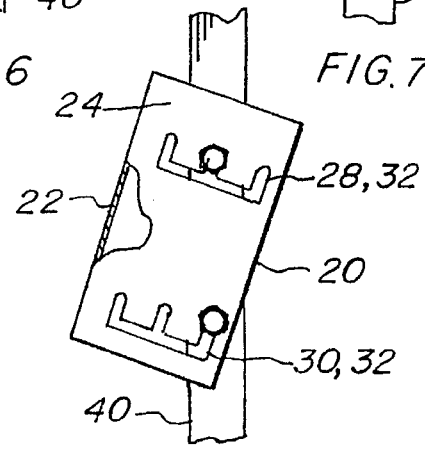
FIG. 9 is an elevational view of the E-shaped slotted embodiment in the angular position furthest from the frame.

Not only are the three positions available as depicted in FIGS. 5–7, the bracket may be changed angularly as well as its relative distance from the frame upright 40. FIG. 8 illustrates a first angular position where the threaded fasteners are positioned in the upper slot nearest the face 22 and the lower slot 30 in the center, tipping the bracket 20 angularly. FIG. 9 shows another spacing position in which the bracket 20 is further away from the frame, in the next combination of slots, retaining a similar angular relationship.

The bracket 20 is attached to the back pad cushion 26 with fastening means through a set of holes 42 in the face 22. These fastening means may be in the form of a number of hex bolts 36 screwed into threaded inserts 44 in the back pad cushion 26 or if the cushion 26 includes a wood backing, lag bolts 46 or wood screws 48 may be employed with equal ease. A carriage bolt, not shown, may also be utilized with the head inside the back pad and the threads protruding therefrom with a nut to complete the attachment.

The preferred embodiment in the arc shaped slot configuration is depicted in FIGS. 3 and 10–12. The bracket 20 includes the same mounting face 22 and parallel outwardly extending arms 24 except the arms are radiused instead of rectangular. The upper slot means differs slightly as an arc shaped slot 50 is utilized. This arc shaped slot 50 contains a vertical riser 52 on each end as depicted in the exploded view of FIG. 10. The slot contour permits two distinct adjustments, one on each riser 52 with the slot inbetween for communication thereof.

Figure 10:
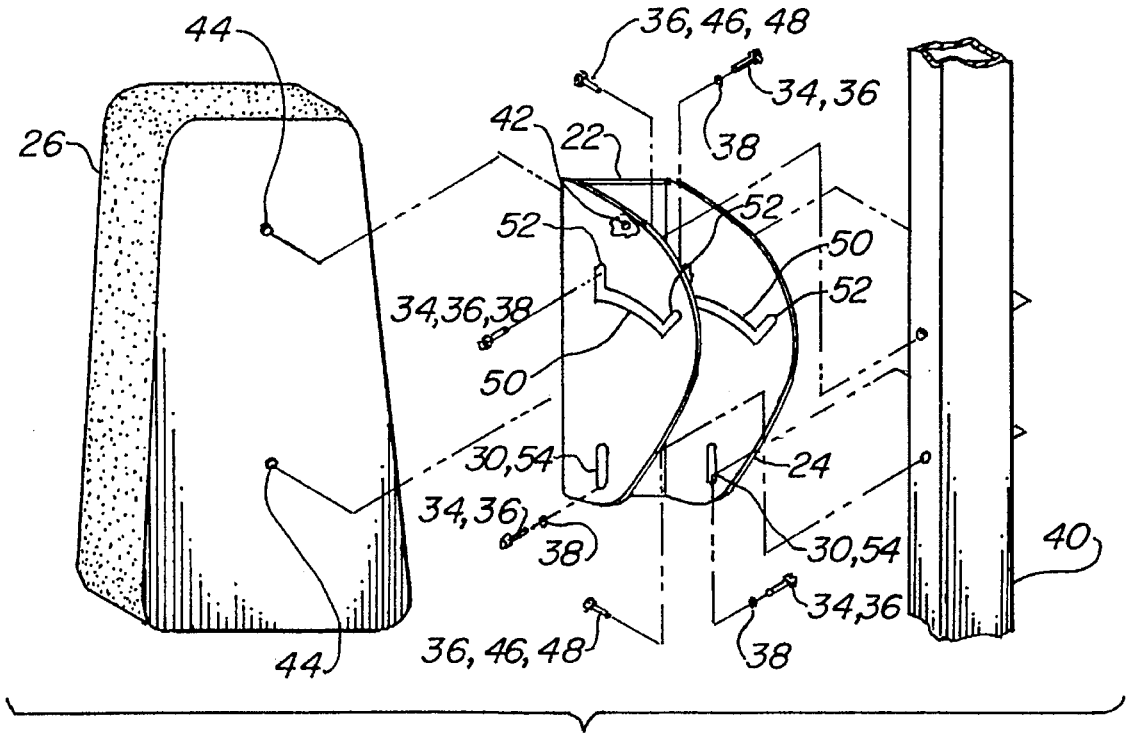
FIG. 10 is an exploded partial isometric view of the arc shaped slotted embodiment.
Figure 11:
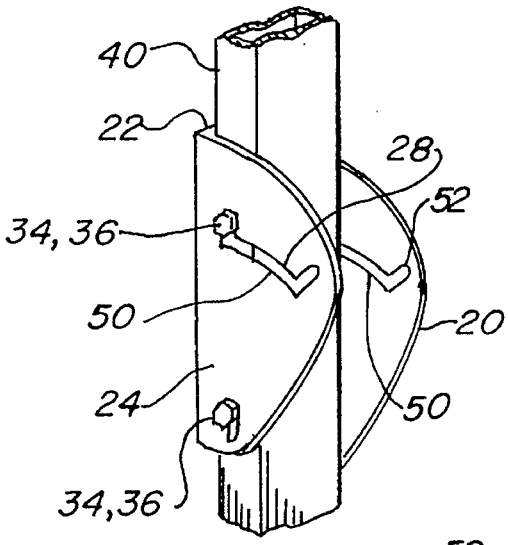
FIG. 11 is an elevational view of the arc shaped slotted embodiment in the vertical position.
Figure 12:
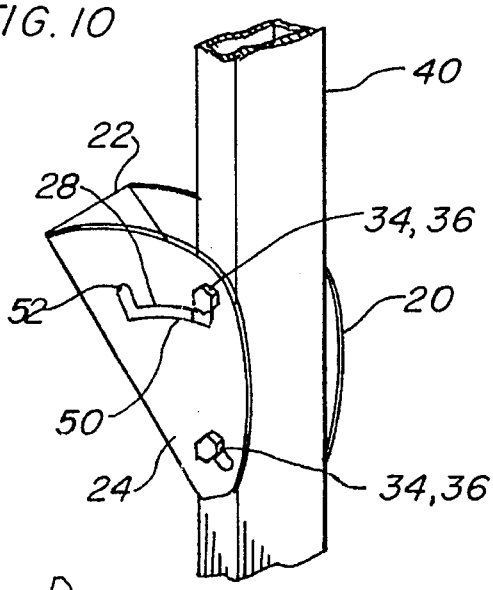
FIG. 12 is an elevational view of the arc shaped slotted embodiment in the angular position.

The lower slot means consists of a single vertical slot 54 again best illustrated in FIG. 10. With this combination of slot means, the bracket face 22 may be parallel with the frame upright 40 as depicted in FIG. 11 where the upper threaded fastener is in the riser 52 nearest the face 22. FIG. 12 shows the angular adjustment basically used in the shoulder press mode where the individual requires the back pad cushion 26 to tilt forward. The lower vertical slot remains the same however, the opposite vertical riser 52 is used with the adjustment made in the same manner by lifting upon the bracket 20.

In use, the cushion 26 is attached to the bracket 20 and the assembly is retained by the threaded fasteners at the frame's vertical upright 40. When an adjustment is required, the user lifts upon the bracket and slides the assembly into the desired position through the upper and lower slot means. No retainer is required as the bracket is contained in all directions except upwards where the weight of the cushion 26 and bracket 20 holds them in place securely.

Figure 4:
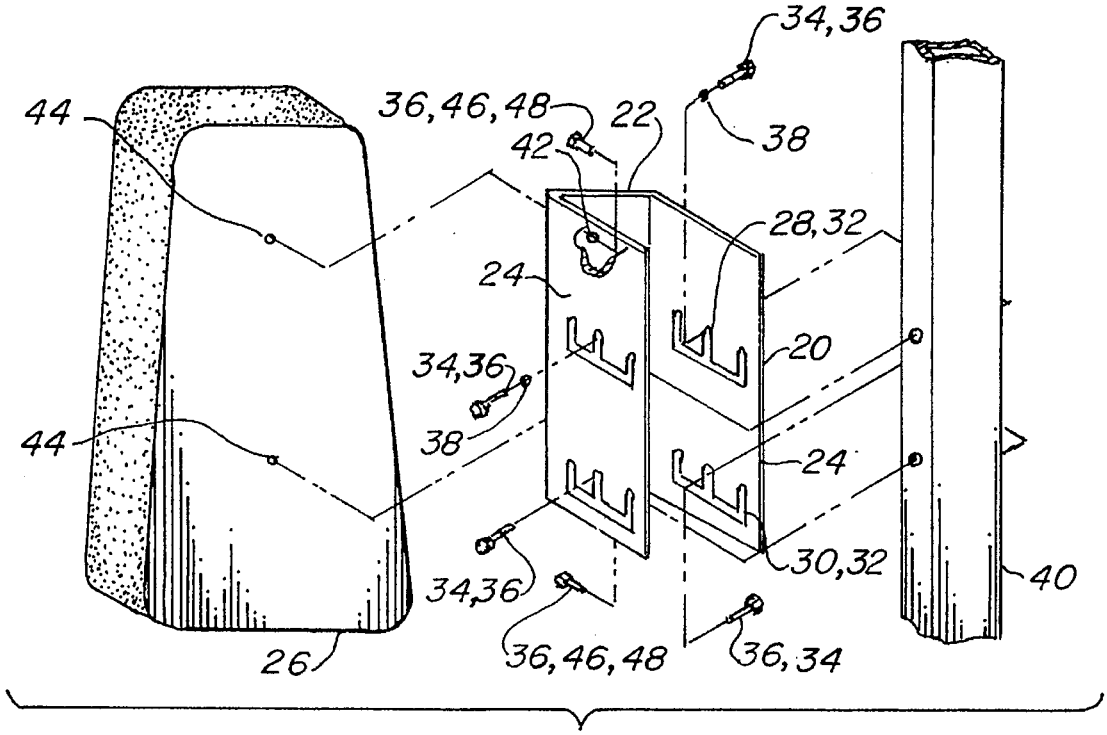
FIG. 4 is an exploded view of the E-shaped slotted embodiment.

FIGS. 4 and 10 illustrate the two configurations of the preferred embodiments in an exploded view with phantom lines showing their attached relationship.

Figure 13:
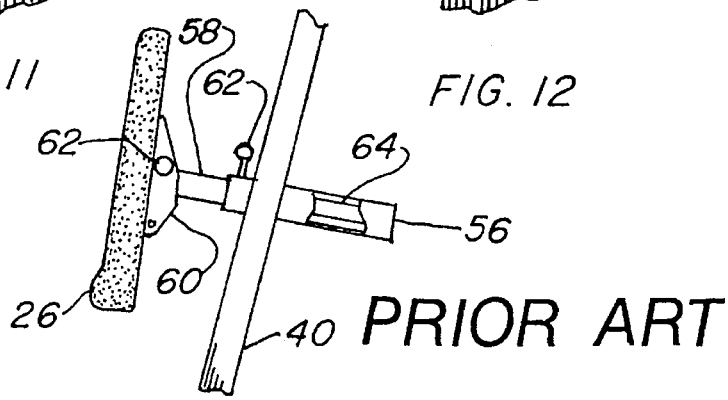
FIG. 13 is a partial isometric view of the prior art method of adjustment.

FIG. 13 illustrates one embodiment of the prior art used to hold the cushion in place while allowing adjustment. A hollow rectangular tube 56 is welded onto the gym frame upright 40 at the appropriate angle. An adjustment tube 58 slides inside the tube 56 and contains a plate that is bolted to a back pad bracket 60 which in turn attaches to the back pad cushion 26. A plastic handled pin 62 is pulled out and a new set of holes within the adjustment tube 58 are aligned and the new position is selected. The angle adjustment is accomplished in the same manner. A gas cylinder 64 is sometimes utilized to push the cushion forward and the user then must retract the seat manually against the force exerted by the cylinder. In any event, the prior art was only illustrated to show its complexity and method of adjustment.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

The invention claimed is:

1. A back-pad cushion adjusting device for use on a multi-station gym said device comprising:

a) a back pad cushion flat mounting face, having a matching rear surface permitting a contiguous mating to a gym frame, b) a pair of parallel outwardly extending arms angularly contiguous with the mounting face unitedly forming a channel shaped bracket, c) each of the arms having opposed plural positioning upper slot means therewithin, d) each of the arms having opposed lower slot means therewithin, both opposed plural positioning upper slot means and lower slot means are congeneric, each form an inverted "E" slot with each partition of the slot wide enough to clear threaded fasteners and slide unobstructally throughout the entire shape of the "E", said slots positioned equal distance from the front of the arms, the "E" shaped slots permitting three separate spaced positions a distance apart from a gym frame upright with fasteners in adjoining slots, and two additional positions at a tilted angle using upper ends of dissimilar slots, e) a hex bolt and spacer threaded fastener spaceably disposed through each of the slot means and for connecting to the frame upright such that when the bracket is lifted upwardly and shifted, the fasteners may be relocated into alternate positions within the slot means, and f) back pad cushion fastening means in the form of hex bolts for attaching a cushion to the mounting face of the channel shaped bracket.

2. A back-pad cushion adjusting device for use on a multi-station gym, said device comprising:

a) a back pad cushion flat mounting face, having a matching rear surface permitting a contiguous mating to a gym frame, b) a pair of parallel outwardly extending radiused arms angularly contiguous with the mounting face unitedly forming a channel shaped bracket, c) each of the arms having opposed plural positioning upper slot means therewithin, further the upper slot means defines an arc shaped slot with a vertical riser on each end wide enough to clear threaded fasteners, the arc shaped slot permitting two spaced tilted angularly disposed positions using a fastener in one or the other slot riser, d) each of the arms having opposed lower slot means therewithin, defining a vertical slot wide enough to clear threaded fasteners, e) a hex bolt and spacer threaded fastener spaceably disposed through each of the slot means and for connecting to a gym frame upright such that when the bracket is lifted upwardly and shifted, the fasteners may be relocated into alternative positions within the upper slot means and rotate within the lower slot means, and f) back pad cushion fastening means in the form of hex bolts for attaching cushion to the mounting face of the channel shaped bracket.

* * * * *